United States Patent [19]

Berube

[11] Patent Number: 5,057,817

[45] Date of Patent: Oct. 15, 1991

[54] INTRUDER DETECTION SYSTEM WITH PASSIVE SELF-SUPERVISION

[75] Inventor: James E. Berube, Farmington, N.Y.

[73] Assignee: Detection Systems, Inc., Fairport, N.Y.

[21] Appl. No.: 576,055

[22] Filed: Aug. 31, 1990

[51] Int. Cl.[5] ..... G08B 29/00

[52] U.S. Cl. ..... 340/506; 340/509; 340/514; 340/518; 340/523; 340/526; 340/527; 340/528

[58] Field of Search ..... 340/506, 509, 517, 518, 340/523, 526, 527, 528, 541

[56] References Cited

U.S. PATENT DOCUMENTS 4,611,197 9/1986 Sansky ..... 340/527

OTHER PUBLICATIONS

Detection Systems DS7100, 130 Perinton Parkway, Fairport, N.Y. 14450, May 16, 1991.

*Primary Examiner*—Edward L. Coles, Sr.
*Assistant Examiner*—Wader Sayegh
*Attorney, Agent, or Firm*—Warren W. Kurz

[57] ABSTRACT

A multizone intruder detection system comprises a supervisory circuit for verifying, from normal traffic or activity in each of the zones of protection while the system is disarmed, that each of the intrusion sensors is, indeed, functional. In the event one or more sensors does not trip (i.e., sense activity) during the disarm period, the supervisory circuitry inhibits re-arming of the system until the non-tripped senso(s) is "walk-tested" to verify that it is still functional. According to the invention, a programmable timer enables rearming of the system for a predetermined (preferably brief) time interval immediately following disarmig of the system. This feature offers the edvantage of allowing the user to re-enter the protected premises "after hours" for a brief period of time without having to walk-test all zones of protection before re-arming the system.

5 Claims, 2 Drawing Sheets

INTRUDER DETECTION SYSTEM WITH PASSIVE SELF-SUPERVISION

CROSS-REFERENCE TO RELATED APPLICATIONS

Reference is made to the commonly assigned U.S. application Ser. No. 07/576,013, filed concurrently herewith in the names of Karl H. Kostusiak and James E. Berube and entitled MULTIZONE INTRUDED DETECTION SYSTEM WITH FORCED WALK-TEST.

BACKGROUND OF THE INVENTION

The present invention relates to field of intrusion detection and, more particularly, it relates to improvements in multizone intrusion detection systems of the type which passively supervise the operating status of the intrusion detecting sensors which define the different zones of protection.

An intrusion detection system in which the various intrusion-sensing elements are non-functioning is, of course, of psychological value only. Obviously, in a multizone system in which each zone of protection is defined by the field of view or detection range of each of a plurality of sensors (e.g., microwave, passive-infrared, photoelectric, ultrasonic, passive-acoustic, etc.), the level of security depends on the percentage of sensors which are functioning at any given time. Since a non-functioning sensor is not easy to detect without actually "walk-testing" the sensor to determine whether it produces an alarm output, it is becoming increasingly common to incorporate a so-called "supervisory" circuit in such systems to monitor the operating status of each sensor (or at least those which are particularly prone to fail). Such circuit operates to activate a "supervisory" alarm (e.g., a light-emitting diode) to alert the user of any sensor failure. Detection systems incorporating such supervisory circuits are disclosed, for example, in the commonly assigned U.S. Pat. No. 4,660,024 to R. L. McMaster.

In the commonly assigned U.S. application Ser. No. 492,482, filed on Mar. 12, 1990 in the name of W. S. Dipoala, there is disclosed a dual-technology (passive-infrared/microwave) intruder detection system in which both sensors are "actively" supervised by periodically simulating, within the system, a target of interest. In the event of either sensor failure, a supervisory alarm is given. While such "active" supervision provides optimal protection against sensor failure, it does so at the expense of requiring target-simulation apparatus within each sensor device.

Recently, it has become known to "passively" supervise the various sensors of a multizone system by monitoring the pedestrian-produced activity of the sensors during the period that the system is disarmed, e.g., during the daylight hours in which the protected premises are being used by the owner of the system. The supervisory apparatus includes a display which indicates which of the several sensors have been activated during the disarm period and, hence, are functional; it also, of course, indicates those which have not been activated. To prevent the system from being re-armed without having the operability of those non-activated sensors verfied (e.g., by walk-testing), such control device can be programmed to inhibit re-arming until it detects that all sensors have been activated. While this arrangement provides a high degree of security, it can be a nuisance to a user who, for example, arms the system after verifying that all sensors are functional and then realizes that he forgot something inside the protected premises. To re-enter such premises, even for a moment, means that he must walk-test all sensors, since there is no intervening traffic to do this job for him. Because of this inconvenience, there may be some reluctance on the part of the security customer to opt for this very effective passive supervisory feature.

SUMMARY OF THE INVENTION

In view of the foregoing, an object of this invention is to make the aforedescribed "passive" supervisory feature of conventional intruder detection systems more convenient to the system user.

By virtue of the apparatus of the present invention, a disarmed, multizone intruder detection system embodying the aforedescribed passive supervision feature is re-armable if either of two conditions prevail, namely, (a) all of the intrusion sensors have been activated during the disarm period, or (b) an attempt to re-arm occurs within a relatively brief, predetermined time interval (e.g., within one hour) immediately following disarming of the system. In accordance with a preferred embodiment, the latter condition is provided by a programmable timer which provides a continuous signal for a predetermined time interval each time a disarm signal is produced by the system user. Preferably, the timer output, together with the output of the system's supervisory circuit (indicating that all sensors have been activated during the disarm period) serve as the input to a logical OR gate which provides an arm-enabling signal whenever either of its inputs is present.

The invention and its various advantages will become better understood from the ensuing detailed description of preferred embodiments, reference being made to the accompanying drawings.

DETAILED DESCRIPTION OF PREFERRED EMBODIMENTS

Figure 1:
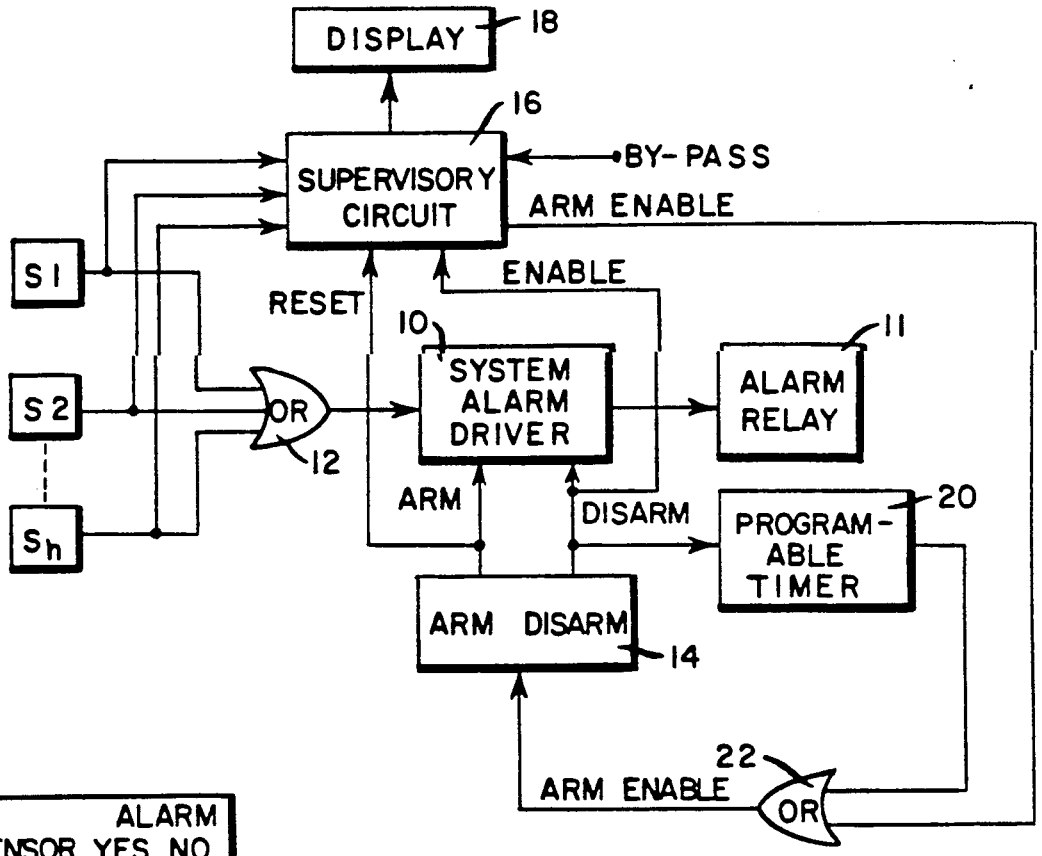
FIG. 1 is a functional block diagram of a multizone intruder detection system embodying the present invention.

Referring now to the drawings, FIG. 1 schematically illustrates a multizone intruder detection system embodying the invention. Such system comprises a plurality of intrusion sensors S1–SN, each having its own discrete field of view or zone of protection within a region protected by the system. Each of the intrusion sensors may take any of a variety of forms adapted to sense some characteristic of intrusion, e.g., a change in thermal energy, a disturbance of standing waves of ultrasonic or microwave energy, a change in position of an object, such as a door or window, a change in noise level, etc. Each intrusion sensor is adapted to produce a sensor alarm signal on its output in response to a predetermined type of change in the intrusion characteristic for which it was designed.

The respective outputs of sensors S1–SN are connected to the input of a system alarm circuit 10 through a logical OR gate 12. When armed, as described below, system alarm 10 is designed to activate a system alarm 11, such as an audible noise sourceor a message communication system, e.g., an automatic telephone dialer, in the event any one of the different intrusion sensors detects intrusion and produces a sensor alarm.

Arming and disarming of system alarm 10 is achieved by an arm/disarm circuit 14 which applies either of two different voltages to the system alarm. When an "arming" voltage is applied, the system alarm becomes responsive to the sensor alarms and will produce the aforementioned system alarm in the event any sensor alarm is produced. When a "disarm" voltage is applied, the system alarm is non-responsive to the sensor alarms, and the user may enter and move about the protected premises without any concern that a system alarm will be sounded. In order to produce an "arm" signal, however, the arm/disarm circuit must receive an "arm-enable" signal, as explained below.

Figure 2:
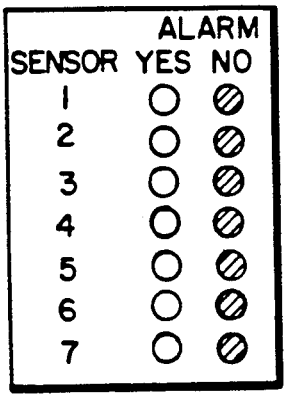
FIG. 2 is a typical supervisory display useful in the FIG. 1 system.

In a conventional manner, the "activity" of each of the intrusion sensors is monitored by a supervisory circuit 16 which, when enabled by a "disarm" signal from the arm/disarm circuit 14, operates to exhibit on a display 18 (FIG. 2), which of the sensors have produced a sensor alarm since the most recent "disarm" signal was produced. Note, the supervisory display is reset (to show that none of the sensors has alarmed) each time an "arm" signal is produced. The supervisory circuit comprises a logical AND gate which produces an "arm-enable" signal only in the event all of the intrusion sensors have shown activity (i.e. produced a sensor alarm) since the most recent "disarm" signal was produced. This "arm-enable" signal is applied to the arm/disarm circuit 14 to allow re-arming of the system following a disarm period. By allowing the normal "daytime" traffic in the protected premises to activate the sensors and thereby verify their operability, the need to "walk-test" all sensors prior to re-arming is mitigated.

The multizone, self-supervised, intruder detection system shown and described to this point is of known design. While this system provides a relatively high degree of security, it may be appreciated that this system presents an inconvience to one who has a need to re-enter the protected premises before the time at which the system is normally disarmed. For example, should the system user arm the system, and then recall that he forgot to perform some task within the now-protected premises, he will suffer the disadvantage of having to "walk-test" all of the intrusion sensors should he decide to disarm the system to attend to that task. This inconvenience is, of course, compounded as the number of sensors increases.

Now, in accordance with the present invention, the above-described disadvantage of the prior art security systems is largely mitigated by the provision of a programmable timing circuit 20. According to a preferred embodiment, timing circuit operates to produce a continuous signal on its output terminal for a predetermined time interval following receipt of a signal at its input. As shown, the timing circuit's input signal is provided by "disarm" signal produced by circuit 14. Together with the output of the supervisory circuit (indicating whether or not all supervised sensors have produced a sensor alarm within the most recent disarm period), the output of the timing circuit is supplied to the inputs of a logical OR gate 22. If either input is present, OR gate 22 provides an "arm-enable" signal to the arm/disarm circuit, allowing such circuit to provide, on command, an "arm" signal to the system alarm 10. Preferably, the time interval of the timing circuit is about one hour. Such a period of time is usually sufficiently long to enable a system user to accomplish what has to be done "after hours", yet is sufficiently short to allow ample time for the supervisory circuit the sensor alarms it requires to produce the requisite "arm-enable" signal after the system has been disarmed, e.g., at the beginning of the business day.

Figure 3:
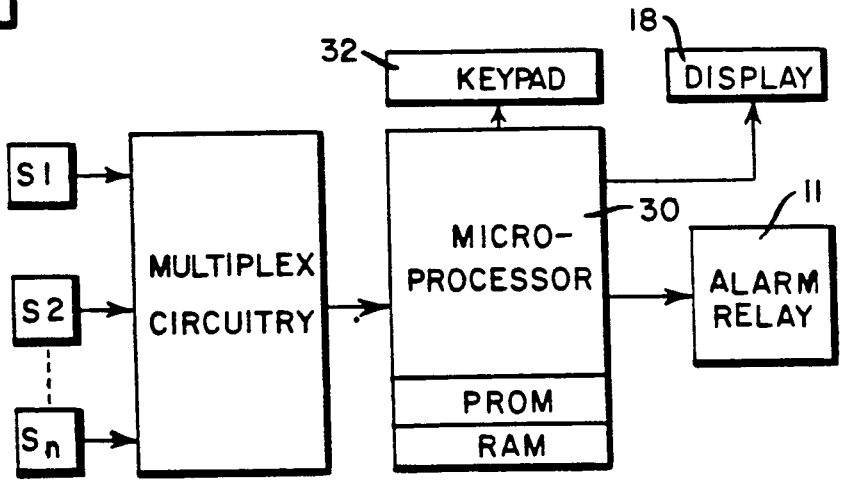
FIG. 3 is a functional block diagram of a microprocessor-controlled multizone intruder detection system embodying the invention.
Figure 4:
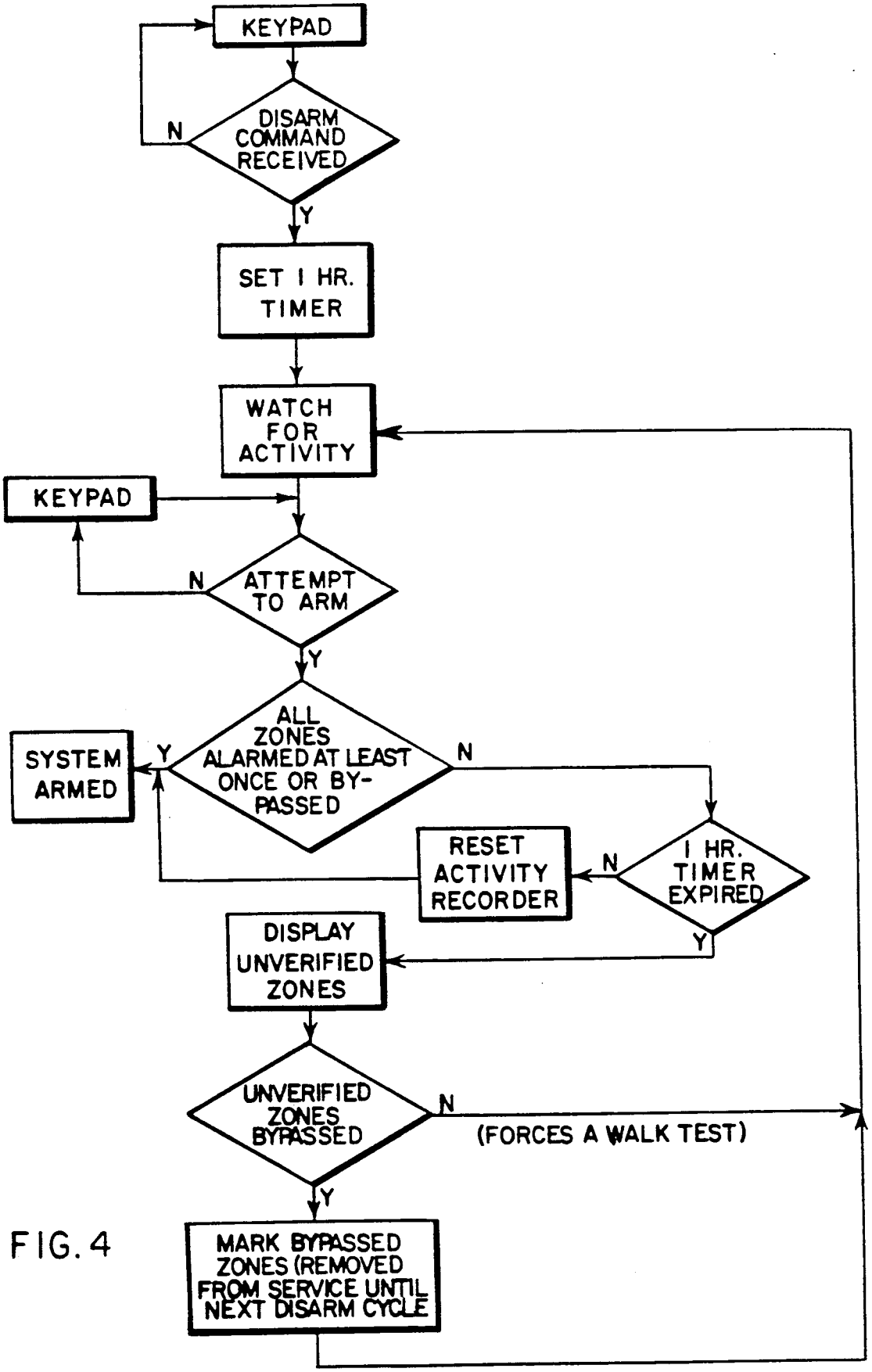
FIG. 4 is a flow chart illustrating preferred programming of the microprocessor used in the FIG. 3 system.

While the apparatus of the invention can be embodied in the hardware shown in FIG. 1, the functions of such hardware, of course, can be provided by a suitably programmed microprocessor 30, shown in FIG. 3, having a programmable read-only memory (PROM) and a random access memory (RAM). Arming and disarming of the system is effected by a keypad 32 which communicates with the microprocessor in a well known manner. Such microprocessor may be programmed to carry out the program shown in the flow-chart of FIG. 4., where it is assumed that the timer is programmed to "time-out" and thereby discontinue producing an output after one hour.

While the invention has been described with reference to preferred embodiments, it will be appreciated that many modifications can be made without departing from the spirit and scope of invention, as defined by the appended claims.

What is claimed is:

1. A multizone intruder detection system for detecting intrusion in any one of a plurality of zones of protection in a region under surveillance, said system comprising:

(a) a plurality of intrusion sensors, each providing discrete zones of protection and being adapted to produce a sensor alarm signal in response to sensing a characteristic of intrusion occurring in its associated zone of protection;

(b) system-alarm means selectively responsive to a sensor alarm signal being produced by any one or more of said intrusion sensors to produce a system alarm;

(c) system arming-disarming means for selectively arming and disarming said system by rendering said system-alarm means responsive and non-responsive, respectively, to a sensor alarm signal, said system arming/disarming means being responsive to an arm-enable signal applied thereto to enable arming of said system;

(d) passive supervisory means for monitoring the operating status of at least some of said intrusion sensors during a period in which said system is disarmed by detecting the production of sensor alarm signals from each of the monitored intrusion sensors, said passive supervisory means being adapted to produce a first arm-enable signal in the event that each of the monitored intrusion sensors produces a sensor alarm during said disarm period;

(e) timing means, operatively connected to said system arming/disarming means, for producing a second arm-enable signal for a predetermined time interval immediately after said system is disarmed; and (f) logic circuit means for applying either of said first and second arm-enable signals to said system arming/disarming means, whereby said system is, upon being disarmed, re-armable in response to the production of either said first or second arm-enable signals.

2. The apparatus as defined by claim 1 wherein said system arming/disarming means is responsive to a manually produced by-pass signal to allow arming of the system in the event neither said first nor said second arm-enable signals is applied to said system arming/disarming means.

3. The apparatus as defined by claim 1 wherein said timing means is programmable to vary said predetermined time interval.

4. The apparatus as defined by claim 1 wherein said supervisory means comprises a display for displaying which of said sensors has produced a sensor alarm signal after said system has been most recently armed, said supervisory means being responsive to an arm signal produced by said system arming/disarming means to reset said display to indicate that none of said intrusion sensors has produced a sensor alarm signal.

5. The apparatus as defined by claim 1 wherein elements (b) through (f) are embodied in a programmable microprocessor.

* * * * *